US011677187B2

(12) United States Patent
Cairns

(10) Patent No.: US 11,677,187 B2
(45) Date of Patent: Jun. 13, 2023

(54) PRESSURE TOLERANT DEEP-SEA ELECTRICAL CONNECTOR

(71) Applicant: PONTUS SUBSEA CONNECTORS LLC, Ormond Beach, FL (US)

(72) Inventor: James L. Cairns, Ormond Beach, FL (US)

(73) Assignee: Pontus Subsea Connectors LLC, Ormond Beach, FL (US)

( * ) Notice: Subject to any disclaimer, the term of this patent is extended or adjusted under 35 U.S.C. 154(b) by 0 days.

(21) Appl. No.: 17/862,672

(22) Filed: Jul. 12, 2022

(65) Prior Publication Data

US 2022/0344871 A1 Oct. 27, 2022

Related U.S. Application Data

(63) Continuation of application No. PCT/US2020/063965, filed on Dec. 9, 2020.

(60) Provisional application No. 62/961,761, filed on Jan. 16, 2020.

(51) Int. Cl.

| | |
|---|---|
| ***H01R 13/627*** | (2006.01) |
| ***H01R 13/642*** | (2006.01) |
| ***H01R 13/52*** | (2006.01) |
| ***H01R 13/523*** | (2006.01) |

(52) U.S. Cl.

CPC ..... *H01R 13/642* (2013.01); *H01R 13/523* (2013.01); *H01R 13/5219* (2013.01)

(58) Field of Classification Search

CPC . H01R 13/642; H01R 13/5219; H01R 13/523
USPC ..... 439/359
See application file for complete search history.

(56) References Cited

U.S. PATENT DOCUMENTS

| | | | | |
|---|---|---|---|---|
| 3,271,727 A * | 9/1966 | Nelson | H01R 13/523 439/597 |
| 3,277,424 A | 10/1966 | Nelson | |
| 3,397,378 A * | 8/1968 | Dietrich | H01R 13/523 439/205 |
| 3,412,365 A * | 11/1968 | Nelson | H01R 13/523 439/651 |
| 3,546,657 A | 12/1970 | Cook | |

(Continued)

OTHER PUBLICATIONS

International Search Report and Written Opinion for PCT/US2020/063965 dated Feb. 25, 2021.

*Primary Examiner* — Abdullah A Riyami
*Assistant Examiner* — Vladimir Imas
(74) *Attorney, Agent, or Firm* — Mark T. Vogelbacker

(57) ABSTRACT

A connector for sealably engaging contacts therein and permitting reliable disengagement thereof includes a first unit having one or more elongated shafts. Each elongated shaft includes at least one first contact. The connector further includes a second unit having a body with one or more channels therein. Each channel includes at least one second contact. Each channel is configured to receive at least a portion of one of the elongated shafts therein to permit electrical connection of the one or more first contacts to the respective one or more second contacts. The second unit further includes an axial slit extending radially outwardly from each channel toward an outer surface of the body of the second unit. Each slit of the second unit is a circumferentially discontinuous portion of the channel configured to prevent the second unit from forming a constrictive belt around the one or more elongated shafts therein.

10 Claims, 7 Drawing Sheets

(56) References Cited

U.S. PATENT DOCUMENTS

| | | | | | |
|---|---|---|---|---|---|
| 3,626,356 | A * | 12/1971 | Trammell | H01R 13/523 | 439/668 |
| 3,729,699 | A * | 4/1973 | Briggs | H01R 13/523 | 439/271 |
| 3,784,959 | A * | 1/1974 | Horton | H01R 13/523 | 439/948 |
| 3,860,322 | A * | 1/1975 | Sankey | H01R 13/53 | 439/184 |
| 4,299,431 | A * | 11/1981 | Wilson | H01R 13/523 | 439/205 |
| 4,618,198 | A * | 10/1986 | Dale | H01R 13/5219 | 285/334.4 |
| 4,948,377 | A * | 8/1990 | Cairns | H01R 13/523 | 439/271 |
| 5,194,012 | A * | 3/1993 | Cairns | H01R 13/523 | 439/271 |
| 5,376,016 | A * | 12/1994 | Inaba | H01R 13/6273 | 439/364 |
| 5,645,442 | A * | 7/1997 | Cairns | H01R 13/523 | 439/271 |
| 7,355,122 | B2 * | 4/2008 | Moore | H01R 13/523 | 174/92 |
| 8,292,645 | B2 * | 10/2012 | Cairns | H01R 13/5202 | 439/271 |

* cited by examiner

PRIOR ART (NELSON US 3,277,424)

PRESSURE TOLERANT DEEP-SEA ELECTRICAL CONNECTOR

CROSS-REFERENCE TO RELATED APPLICATION

The present application is a continuation of International Patent Application No. PCT/US2020/063965, filed Dec. 9, 2020, and claims priority to U.S. Provisional Patent Application No. 62/961,761, filed Jan. 16, 2020 and titled "PRESSURE TOLERANT DEEP-SEA ELECTRICAL CONNECTOR," the entire disclosure of each is hereby incorporated by reference.

FIELD OF THE PRESENTLY DISCLOSED TECHNOLOGY

Embodiments of the presently disclosed technology relate to an apparatus for sealably connecting and/or disconnecting electrical circuits underwater and/or in other harsh environments.

BACKGROUND

The application relates to rubber molded electrical connectors intended for deep-sea use. Devices for sealably housing the mated contacts of electrical connectors underwater or in other harsh environments came into widespread use during the Second World War with the increased deployment of submarines. Offshore oil and gas exploration and production, both major users of underwater connectors, also became widespread not long afterward. Economical rubber-molded subsea electrical connectors have been used in underwater applications for about the last half century. Despite their long history, there are still deep-sea program requirements which none of the existing rubber molded connectors can fulfill. All prior art rubber-molded connectors can be difficult or impossible to disconnect at great depths, limiting their utility.

The technology disclosed herein can meet the deep-sea requirements that prior art products cannot. In one embodiment, the presently disclosed technology includes a rubber-molded electrical plug and receptacle connector that can be mated and/or unmated underwater at the greatest ocean depths and still can rival the low-cost of prior-art rubber-molded connectors.

Subsea electrical connectors generally fall into two categories: those that can be plugged and unplugged in a dry environment and then submerged, and those that can be plugged and unplugged either in air or underwater. The latter of those are generally called underwater mateable connectors.

There are two basic types of rubber molded underwater mateable connectors now commercially available. Both types use an interference fit between rubber portions of the plug and receptacle to keep the electrical contacts isolated from the seawater when the connector's plug and receptacle are mated. One type employs round-section plug pins having extended shafts whose bases are encapsulated by larger diameter cylindrical rubber sleeves from which the conductive pins protrude. The respective socket contacts are recessed within cylindrical bores. When a plug pin has fully penetrated its respective socket, the heavy rubber sleeve of the plug pin forms a sealed interference fit into its respective cylindrical bore. Upon mating underwater, water contained within the recessed socket bore is mostly forced back out of the recess by the entering pin, but some water can remain trapped around the contacts. When mated in air, some air can remain entrapped around the contacts. This sort of interference-fit connector was introduced commercially by the French company SOURIAU SAS in the 1970's. The fundamental design was never patented. The Souriau type connectors are still widely used but can be very difficult or impossible to disconnect at high deep-sea pressures. When mated in air and then submerged, air can be trapped in the cavities enclosing the pin-socket junctions, and so the cavities do not equalize to ambient sea pressure. As a result, high deep-sea pressure can effectively lock the plug and receptacle together.

Another sort of rubber-molded underwater mateable electrical connector preceded that of Souriau by several years. This type of underwater mateable pin-and-socket electrical connector was disclosed in Nelson's U.S. Pat. No. 3,277,424, a figure from which is reproduced in FIG. 1. The Nelson connectors are extremely simple devices molded from elastomeric material. Examples of these connectors are manufactured by Cooper Industries of Houston, Tex. and/or Eaton of Cleveland, Ohio. In one embodiment the connectors consist of a plug unit 22 with an elongated cylindrical shaft having a rigid spine 23 with electrical contact 24 positioned about midway along its length, and a receptacle unit 11 having bore 26 therethrough. Bore 26 houses split annular electrical contact 30. Plug shaft 22 and plug electrical contact 24 have equal diameters "d".

Receptacle bore diameter D and the diameter of annular contact 30 are equal, and can have a slight interference fit to plug diameter d.

When mated underwater, plug pin 22 enters receptacle bore 26 forcing water out the other end of bore 26. When plug shoulder 20 butts against receptacle end 27, plug contact 24 is within receptacle contact 30. Metal electrical contact 30 is split axially at 31 so that it springs radially apart slightly to insure good electrical contact with contact 24.

Nelson's invention has proved to be enduring, with variations of it currently being produced and widely commercially available. The products are simple to use, and inexpensive enough to be affordable for a wide variety of applications. In the following discussions all connectors based on Nelson's concept or variations thereof will simply be referred to as Nelson connectors.

Nelson wrote in his '424 patent description that because the plug and receptacle bodies are both elastomeric, the mated connector is pressure balanced throughout. The pliability of rubber permits it to nearly equilibrate to the ambient pressure throughout the rubber's volume, thereby eliminating the need for heavy pressure-withstanding housings and/or high-pressure seals. The Nelson connector can tolerate the crushing pressure of the deep sea without such housings. That greatly reduces the product's cost, thus making it generally affordable. In that respect, Nelson achieved a very important goal. However, the Nelson connectors have a flaw that limits their use: like the Souriau connectors, they do not reliably unmate at high ambient pressure.

Both Souriau and Nelson type connectors are commercially available from SEACON, COOPER Interconnect, SOURIAU SAS, and other suppliers.

Droppable elements, such as ballast or battery packs, are frequently connected to manned or remotely operated underwater vehicles. The ballast is intended to be jettisoned from the vehicles prior to ascent at the end of the operations, or in case of emergency ascents. Existing rubber molded connectors such as those of Nelson and Souriau should not be used to electrically connect droppable ballast because they might not disconnect when the ballast is jettisoned, thus presenting a safety hazard. In fact, they are not suitable for any deep-sea operations in which they must be demated at depth.

SUMMARY

Prior-art rubber-molded underwater connectors cannot be reliably disconnected at great ocean depths due to pressure locking. That problem is addressed in the disclosed technology wherein embodiments provide for an apparatus which can include a first connector unit (hereafter called the "plug" or the "plug unit") and a second connector unit (hereafter called the "receptacle" or the "receptacle unit"), which can be repeatedly connected and disconnected underwater at any depth without loss of integrity. Disclosed connector receptacles can be constructed with bores, herein also referred to as channels, each channel intended to elastically receive at least a portion of a respective shaft of the plug unit. The channels can have portions extending axially therein that do not sealably conform to plug shafts inserted therethrough. The nonconformity in the disclosed embodiment is hereinafter referred to as a slit; however, other sorts of discontinuities in the conformity could work equally well. The slitted channels can keep the rubber receptacle bodies from forming a constrictive belt around the plug shafts, thereby reducing the pressure-induced grip on the shafts even at high operational pressure. The slit can be such that the electrical contacts remain isolated from environmental fluid when the plug and receptacle units are mated. The described embodiments are intended for use subsea, but could be used in myriad applications, for example wherein pin and socket contacts, when connected, must remain sealed and electrically isolated from each other and from the in-situ environment.

Connector embodiments including at least some of the presently disclosed technology's salient features are presented herein in general terms without regard to any specific application.

In one aspect, the presently disclosed technology is directed to a connector for sealably engaging contacts therein and permitting reliable disengagement thereof. The connector can include a first unit having one or more elongated shafts. Each elongated shaft includes at least one first contact. The connector can further include a second unit having a body with one or more receptacle channels therein. Each receptacle channel includes at least one second contact. Each receptacle channel is configured to receive at least a portion of one of the elongated shafts therein to permit electrical connection of the one or more first contacts to the respective one or more second contacts. The second unit can further have an axial slit extending radially outwardly from each receptacle channel toward an outer surface of the body of the second unit. Each slit of the second unit can be configured to prevent the second unit from forming a continuous constrictive belt around the one or more elongated shafts therein.

Optionally, each axial slit of the second unit extends an entire length of the respective receptacle channel from one end of the second unit to an opposing end of the second unit. Alternatively, one or more of the axial slits of the second unit extends at least slightly less than the entire length of the respective receptacle channel.

The one or more axial slits can extend radially outwardly from each alignment bore of the first unit. Each axial slit of the first unit is configured to prevent the one or more alignment bores from forming a continuous constrictive belt around the respective alignment pin of the second unit.

In another aspect, the presently disclosed technology is directed to a connector receptacle unit for sealably engaging contacts therein and permitting reliable disengagement thereof. The receptacle unit can include a receptacle body having a channel therein including a second contact. The channel can be configured to receive an elongated shaft of a plug unit of a connector. The second contact is configured to electrically connect to a first contact of the plug unit when the elongated shaft enters the receptacle channel. An axial slit extends radially outwardly from an outer surface of the receptacle channel.

In still another aspect, a multiple circuit connector unit can contain one or more channels, each channel including one or more electrical contacts therein, each channel configured to receive an elongated plug shaft, and wherein the connector unit can also include one or more elongated shafts wherein each elongated shaft includes at least one first contact.

In yet another aspect, the presently disclosed technology is directed to a method for permitting sealable engagement and disengagement of plug and receptacle contacts. The method includes forming an axial slit that extends radially outwardly from an outer surface of a channel within a receptacle unit, the channel housing one or more electrical contacts.

BRIEF DESCRIPTION OF THE DRAWINGS

It will be easily understood that the described apparatus can be readily adapted to a wide variety of contact numbers and arrangements, sizes, materials, and/or configurations. Other features and advantages of the presently disclosed technology will become more readily apparent to those of ordinary skill in the art after reviewing the following detailed description and the accompanying drawings, in which like reference numbers refer to like parts.

DETAILED DESCRIPTION

Figure 1:
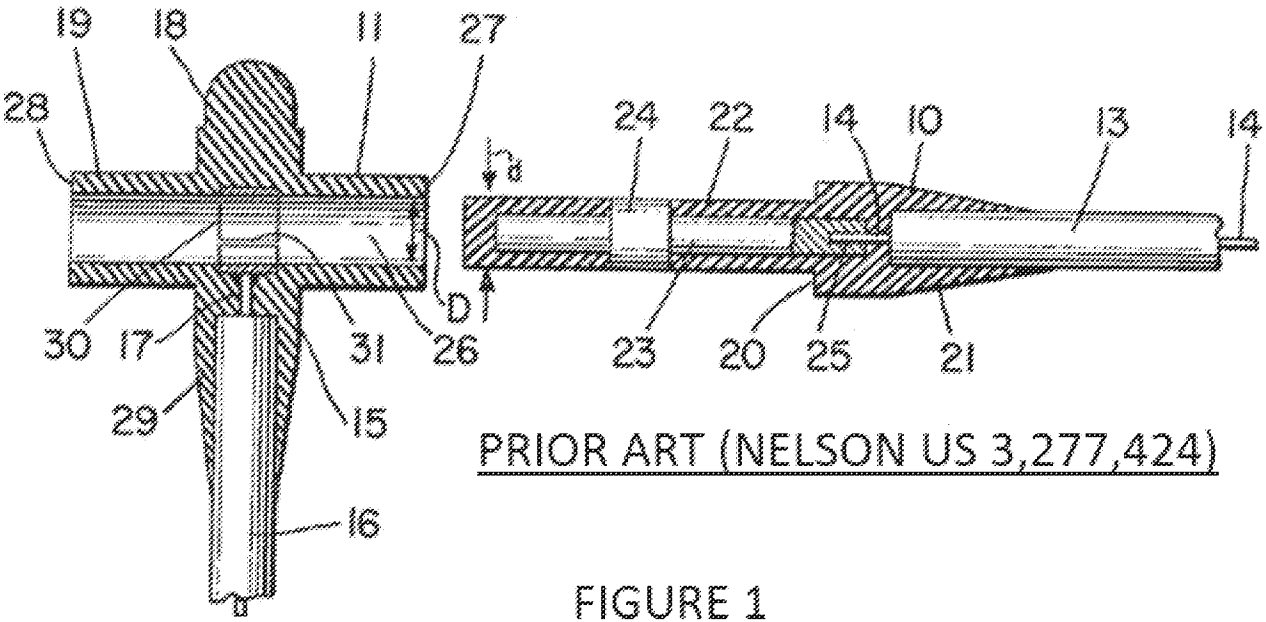
FIG. 1 is an axial cross-sectional view of prior-art Nelson connector plug and receptacle units juxtaposed axially in position for mating.

Certain terminology is used in the following description for convenience only and is not limiting. The words "forward" and "rearward" (and derivations thereof) designate directions in the drawings to which reference is made. The phrase "radially outwardly" as used herein is meant to cover any shape and/or configuration that extends in a direction outwardly in a radial sense and is not limited to shapes and/or configurations that extend radially along a straight line. Unless specifically set forth herein, the terms "a," "an" and "the" are not limited to one element but instead should be read as meaning "at least one." The terminology includes the words noted above, derivatives thereof and words of similar import. FIGS. 1 through 6 are for instructive purposes only and are included to allow the reader to more easily appreciate the fundamental characteristics of the disclosed technology.

Figure 2:
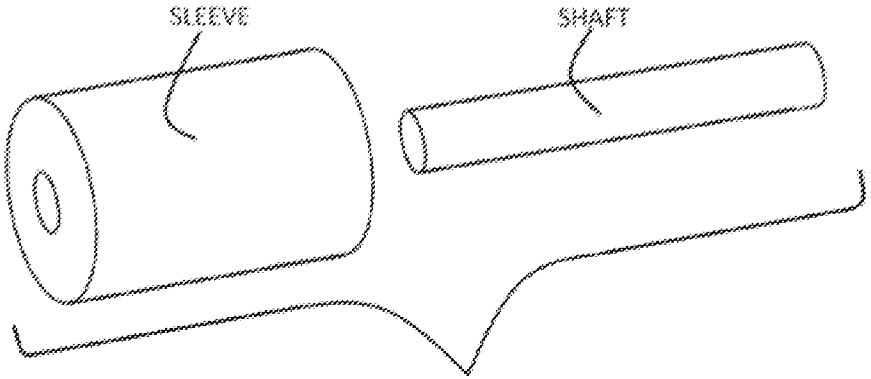
FIG. 2 shows a heavy-walled elastomeric sleeve and a cylindrical shaft juxtaposed for insertion into the sleeve as known in the prior art.
Figure 6:
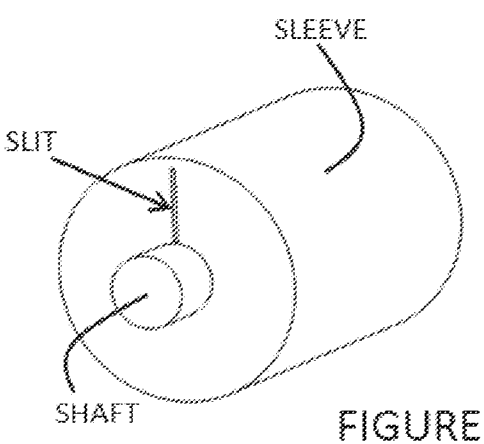
FIG. 6 shows a heavy-walled elastomeric sleeve with a cylindrical shaft inserted into the sleeve wherein the sleeve bore is partially slit radially, and the slit extending through axially.

To understand the shortcomings of Nelson's connector, and the technology herein disclosed to overcome them, imagine a heavy-walled sleeve and a shaft as shown axially aligned in proximity in FIG. 2. Thermal and other effects are ignored in this discussion.

In a first case, suppose that the FIG. 2 sleeve is essentially not compressible, as would be a metal pipe, but that the shaft is a compressible elastomer whose volume shrinks under pressure. The shaft is sized to just sealably slip fit into the sleeve at atmospheric pressure as in FIG. 3. Under high, uniform pressure, the elastomeric shaft would shrink and the metal sleeve would not; the shaft's diameter would become less than the inner diameter of the sleeve, and so would fit loosely within it, and therefore would not seal to it.

Figure 3:
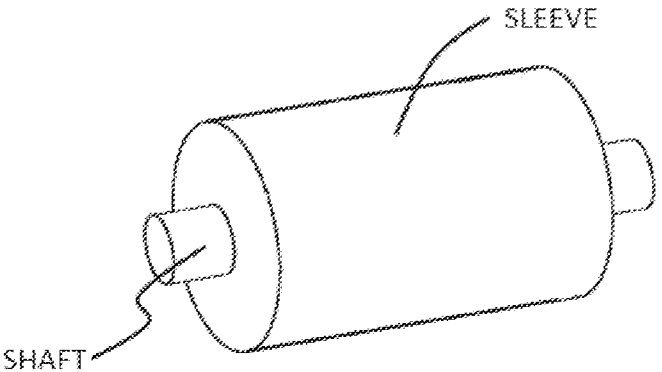
FIG. 3 illustrates a heavy-walled elastomeric sleeve with a cylindrical shaft inserted into the sleeve as known in the prior art.

As a second case, now suppose the opposite circumstances wherein the FIG. 3 shaft is made of an incompressible metal, and the sleeve is a compressible elastomer. Once again, the shaft is sized to just sealably slip fit into the sleeve at atmospheric pressure.

Figure 4:
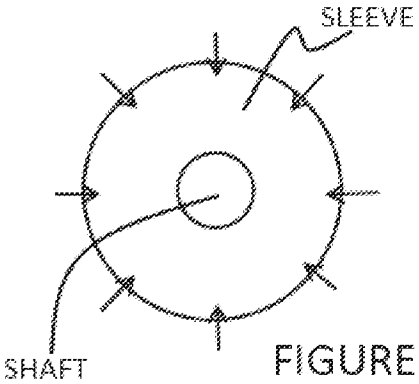
FIG. 4 is an end view of a heavy-walled elastomeric sleeve with a cylindrical shaft inserted into the sleeve as known in the prior art.

Under high uniform pressure, the metal shaft would essentially not compress but the elastomeric sleeve would; the sleeve would shrink down tightly around the shaft exerting a radially directed inward force as indicated by the arrows in FIG. 4.

The preceding discussion makes it clear that for the interface between the sleeve and shaft in a Nelson style connector to remain sealed, a necessary condition is for the compressibility of the sleeve to be greater than or equal to that of the shaft. If the Nelson sleeve and shaft are molded from the same rubber, that condition is met due to the rigid spine within the plug shaft that reduces the shaft's overall compressibility.

Figure 5:
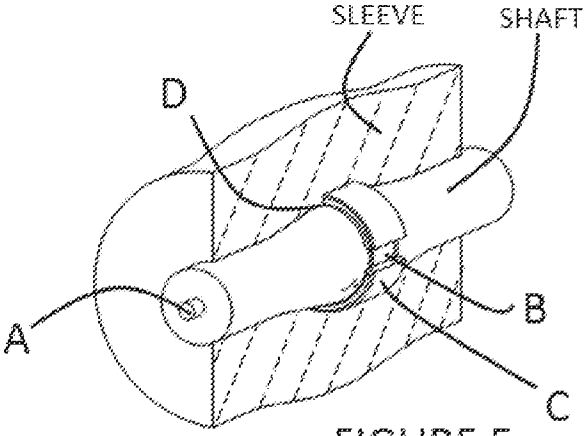
FIG. 5 is a perspective conceptual view of mated Nelson-like connector portions as known in the prior art with the rubber sleeve cutaway axially.

FIG. 5 is an exaggerated conceptual illustration of a Nelson-like connector partially cut-away and otherwise shown as it might appear under very high pressure. It is composed of elastomeric sleeve and shaft portions and metal portions A, B, and C. The elastomeric sleeve and shaft portions are seen to be shrunk from the pressure. Under pressure, rubber can shrink volumetrically at a rate of about $4.0\times10^{-6}$ per PSI (pounds per square inch). Pressure at the greatest working ocean depth is about $10^4$ PSI. At that pressure rubber would be shrunk by about 0.04 inches per inch.

Spine A, plug contact B, and split receptacle contact C in FIG. 5 are metal and are relatively incompressible, so that the elastomeric sleeve shrinks around them, as well as shrinking around the compressible shaft. A lump can be formed on the compressed shaft by plug contact B. For the plug and receptacle to disengage, the lump must be pulled through the shrunken sleeve, thereby increasing the disengagement force.

Additionally, mating surfaces of plug contact A and split receptacle contact B cannot conform exactly. Under high pressure, rubber will intrude into any uncompensated voids. Contrary to Nelson's statement that his connector is pressure compensated throughout, the non-conformities between the plug and receptacle electrical contacts are not pressure compensated and the surrounding rubber portions will intrude between the contacts such as at point D in FIG. 5. The intrusions further bind the plug and receptacle together under high pressure.

Suppose, as in the case of Nelson's connector, the shaft has significantly less compressibility than the sleeve. Under pressure the sleeve will shrink around the shaft; but now, further suppose that the sleeve's bore has been slitted along its length as indicated at the arrow in FIG. 6. Under uniform pressure, the sleeve will shrink around the less compressible shaft, and shrinkage will cause the slit to open somewhat; however, being circumferentially discontinuous around the shaft, the slitted sleeve cannot exert a belt-like grip on the shaft. The shaft can be withdrawn with little or no pressure-induced force. The sleeve remains elastic under pressure, and therefore its restoring force can resist changes in its shape. Even though the sleeve will shrink relative to the shaft, further opening of the slit beyond that caused by the shrinkage can meet some elastic resistance, and the heavy-walled sleeve can still conform to the shaft with approximately the same elastic force as it did in the unpressurized condition. The slit also allows the "lump" on the shaft caused by the uncompressed plug contact to be easily pulled through the sleeve, and although the slit cannot prohibit the intrusion of rubber into nonconformities between the plug and receptacle contacts, it will lessen their resistance to disengagement.

The foregoing discussion outlining why currently available rubber molded subsea connectors cannot be reliability disconnected at great depth can be useful in understanding the following description of the disclosed technology.

In embodiments of the presently disclosed technology the plug or a plug unit can house one or more elongated shafts including portions which can be overmolded onto an electrically conductive spine. The over-molded portions can be rubber or other dielectric material. One or more contact portions, or "plug contacts," of the electrically conductive spine can be exposed from the over-mold along the length of the shaft to eventually mate with electrical contacts, or "receptacle contacts," within the receptacle. The receptacle or a receptacle unit can house a respective one or more receptacle contacts over-molded within one or more rubber channels. The channels can have an axial cross-section in the form of a bore depicted herein as having a circumferential discontinuity, wherein the discontinuity is a split: however, circumferential discontinuities having other forms can accomplish the functionality of the split. It is sufficient that the discontinuity prevents a continuous belt-like portion of the bore from forming around a substantial length of the shaft. The receptacle contacts can be exposed from the rubber over-mold along the length of the channel. When the plug and receptacle units are joined, the one or more plug shafts can enter respective one or more receptacle channels, thereby sealably joining the one or more plug contacts to respective one or more receptacle contacts within the one or more receptacle channels.

The presently disclosed technology can include means for maintaining rotational alignment of the plug unit and the receptacle. For example, as described in detail below and shown herein, a cylindrical bore and corresponding cylindrical alignment pin can engage and/or complement one another to maintain rotational alignment of the plug unit and the receptacle when the plug unit and the receptacle are engaged. However, other means for maintaining rotational alignment can be employed, such as the use of shaped bodies (e.g., an obtuse triangular extension of the plug unit and a mating obtuse triangle socket shape of the receptacle), an extended flat side of the plug unity to mate to a flat side of the receptacle, or other ways to restrict mating to a single rotational alignment.

As one example, a simple one circuit embodiment of the technology is herein described. As a second example a dual circuit embodiment of the technology is also herein described. It will be obvious to those of ordinary skill that many multiple circuit embodiments can readily be constructed without departing from salient features of the disclosed technology.

Figure 7:
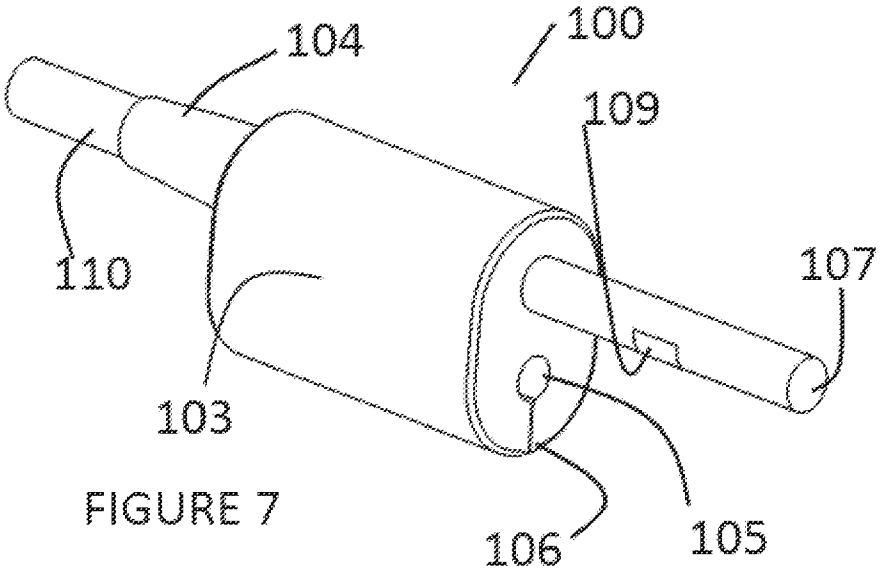
FIG. 7 is a perspective view of connector plug unit in accordance with one embodiment of the presently disclosed technology.

FIG. 7 illustrates plug or plug unit 100 (sometimes referred to as the "first unit"). Plug unit 100 can include optionally molded body 103, cable strain relief 104, at least one through bore 105, with slit 106, shaft 107, plug contact 109, and cable 110.

Figure 9:
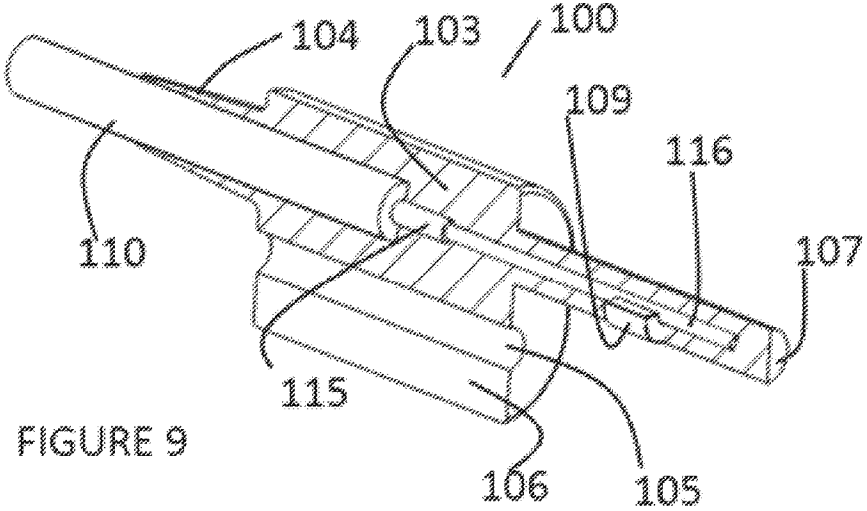
FIG. 9 is a partial axial cross-sectional view of the plug unit of FIG. 7.

FIG. 9 is a perspective view of plug unit 100 with an optionally rubber molded body 103 cutaway axially. Plug shaft 107, optionally formed of elastomer, is shown as having a circular radial cross-sectional shape, but can function equally well with other shapes. Electrical conductor 115 can extend forwardly from cable 110 and can be joined mechanically and electrically to plug spine 116 by routine means, such as but not limited to soldering or crimping. Plug contact 109 is shown as a portion of a cylindrical section (e.g., it does not extend around the entire shaft 107) with equal diameter to shaft 107, but it could have other shapes with portions that approximately conform to portions of the radial cross-sectional shape of shaft 107. Plug contact 109 can be formed as an integral portion of plug spine 116 and can be formed along plug spine 116 such that a portion of plug contact 109 is exposed from overmolded shaft 107 as seen in FIGS. 7 and 9. External surfaces of the various elements molded within rubber plug molded body 103 can be treated in routine ways, for example as by the application of bondable Chemlok substrates provided by Lord Corporation, such that they are both sealed and mechanically bonded within rubber plug body 103.

Figure 8:
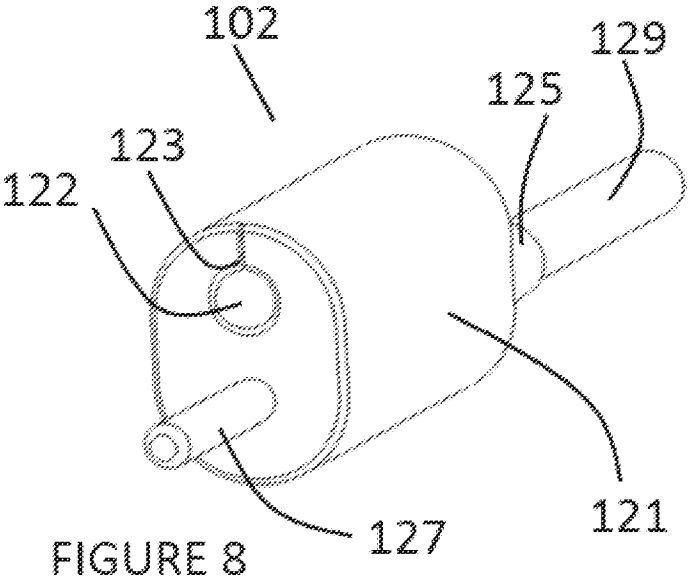
FIG. 8 is a perspective view of a connector receptacle unit in accordance with one embodiment of the presently disclosed technology.
Figure 10:
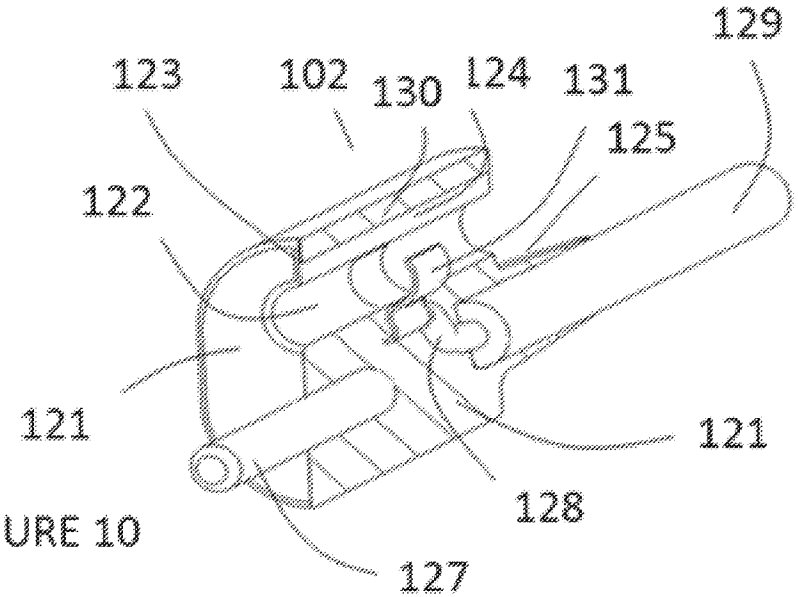
FIG. 10 is a partial axial cross-section view of the connector receptacle unit of FIG. 8.

Receptacle unit 102 shown in FIGS. 8 and 10 can include optionally molded body 121, at least one channel 122 with slit entrance 123 leading into slit 124, cable strain relief 125, at least one alignment pin 127, and conductor 128 extending from cable 129. Each receptacle channel 122 can have the same radial cross-sectional shape as plug shaft 107 and can be sized so that plug shaft 107 has a slight interference fit into receptacle channel 122. Although bore 105 and alignment pin 127 are depicted herein as having a constant cross-sectional shape, other shapes can accomplish the functionality described herein.

Slit entrance 123 of molded receptacle body 121 can be a small radially directed channel that can provide a leak path for exterior environmental fluid to communicate with the forward end of slit 124 even when the plug and receptacle units are fully mated.

Slit 124 can optionally pass axially completely through molded receptacle body 121 (either axially or radially) so that slit 124 can be in communication with environmental fluid on both ends. In one optional embodiment, slit 124 that extends nearly the entire length of receptacle channel 122, but not the entire length of receptacle channel 122, could achieve the desired functionality described herein. Optionally, slit 124 can be interrupted in places along the length and still achieve the desired functionality described herein. In one embodiment, if slit 124 does not extend completely through receptacle unit 102 axially, slit 124 would extend completely through receptacle unit 102 radially and/or radially outwardly. Slit 124 and slit entrance channel 123 can be very narrow so as to limit fouling of slit 124 by marine organisms or debris. Slit 124 in receptacle molded body 121 can extend radially completely through molded body 121; however, it can be desirable in some cases to leave a portion 130 of body 121 uncut so as to add strength and shape stability to molded body 121. Uncut portion 130 can also help restrict marine growth and other sorts of contamination from entering slit 124.

Electrical conductor 128 can extend forwardly from cable 129 and can be joined mechanically and electrically to electrical contact 131 by routine means, such as but not limited to soldering or crimping. External surfaces of the various elements molded within rubber receptacle body 121 can be treated in routine ways, for example as by the application of bondable Chemlok substrates provided by Lord Corporation, such that they are both sealed and mechanically bonded within rubber receptacle body 121.

During the mating of plug unit 100 and receptacle unit 102, each plug shaft 107 first enters one channel 122 of receptacle unit 102, forcing any environmental fluid ahead of plug shaft 107 out the opposite end of channel 122. As engagement of units 100 and 102 proceeds, each receptacle alignment pin 127 enters one bore 105 of plug unit 100.

The full insertion of alignment pin 127 and plug shaft 107 respectively into plug bore 105 and receptacle channel 122 guarantees axial, rotational, and tilt alignment of the mated plug and receptacle units. Slit 106 in plug body 103 can prohibit channel 105 from forming a constrictive belt around pin 127.

FIG. 10 is an axial cross-section of the mated connector illustrating some of the major components of plug unit 100 and receptacle unit 102 in the mated condition.

Figure 11:
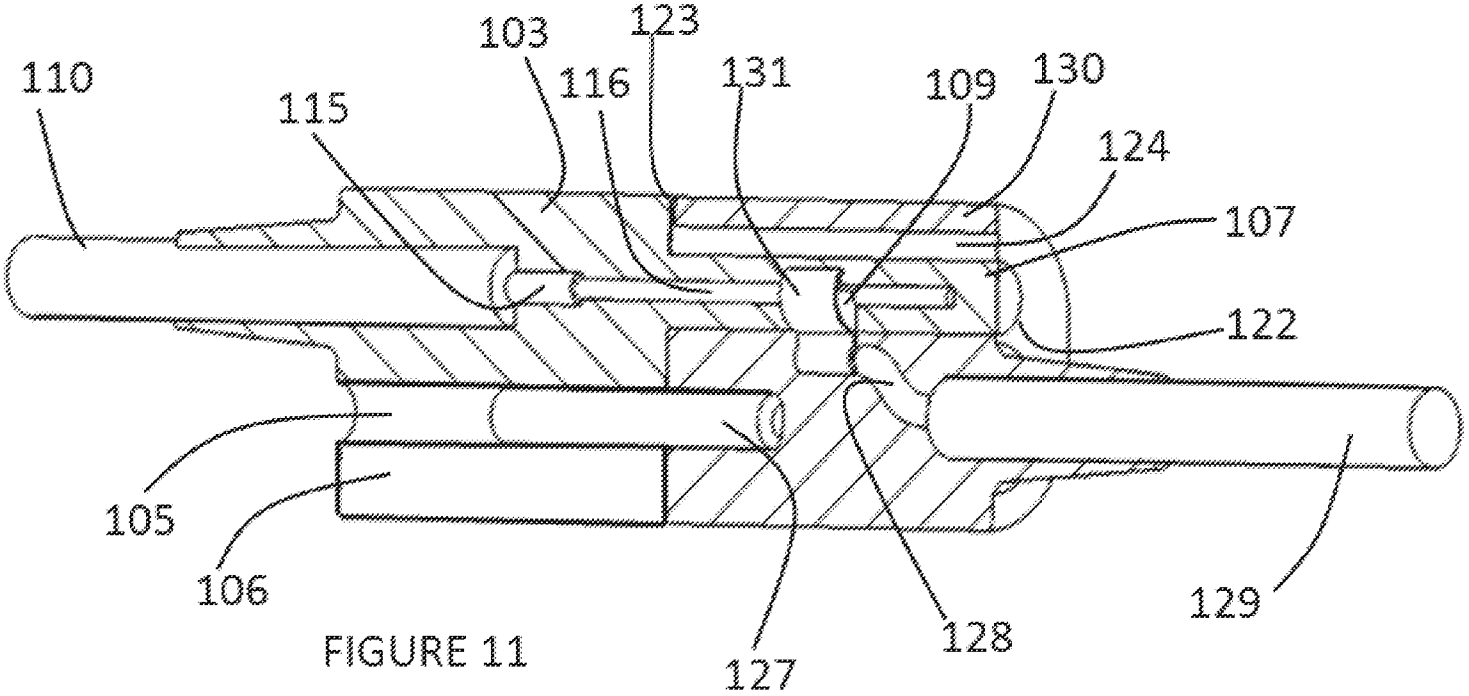
FIG. 11 is a partial axial cross-section view of the mated connector plug and receptacle units.
Figure 12:
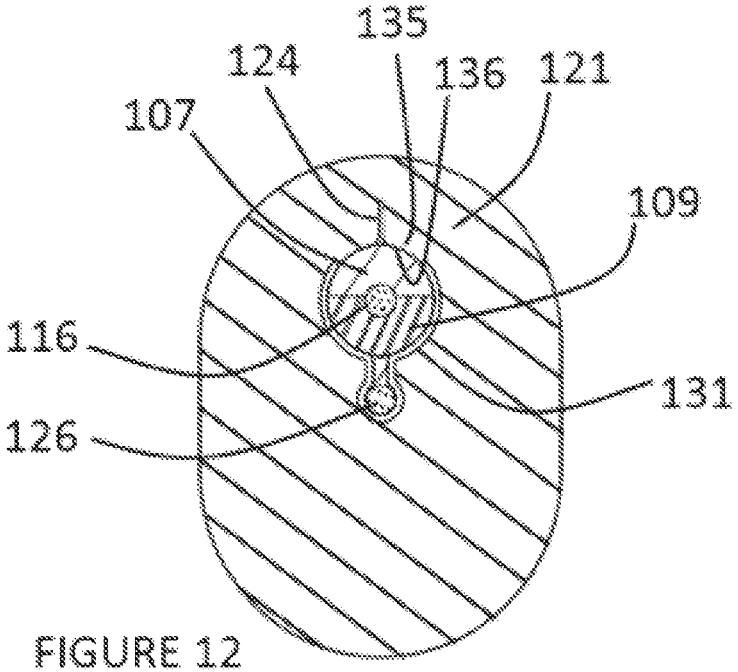
FIG. 12 is a radial cross-sectional view of the mated connector plug and receptacle units taken through the contact area.

FIG. 11 is a radial cross-sectional view through the mated connector at a point where plug contact 109 and receptacle contact 131 are engaged or contact each other. The portion of receptacle contact 131 that engages plug contact 109 can be shaped so as to conform to plug contact 109 with an interference fit, but not to completely surround it. That leaves elastomeric surface portion 135 (FIG. 12) of plug shaft 107 exposed. External surface portion 135 of plug shaft 107 of plug unit 100 can sealably engage elastomeric wall portions 136 of channel 122 (FIG. 10) of receptacle unit 102 on either side of slit 124, thereby prohibiting environmental fluid within slit 124 from contacting receptacle contact 131 or plug contact 109, and simultaneously electrically isolating the electrical contacts from the outside environment.

Figure 13:
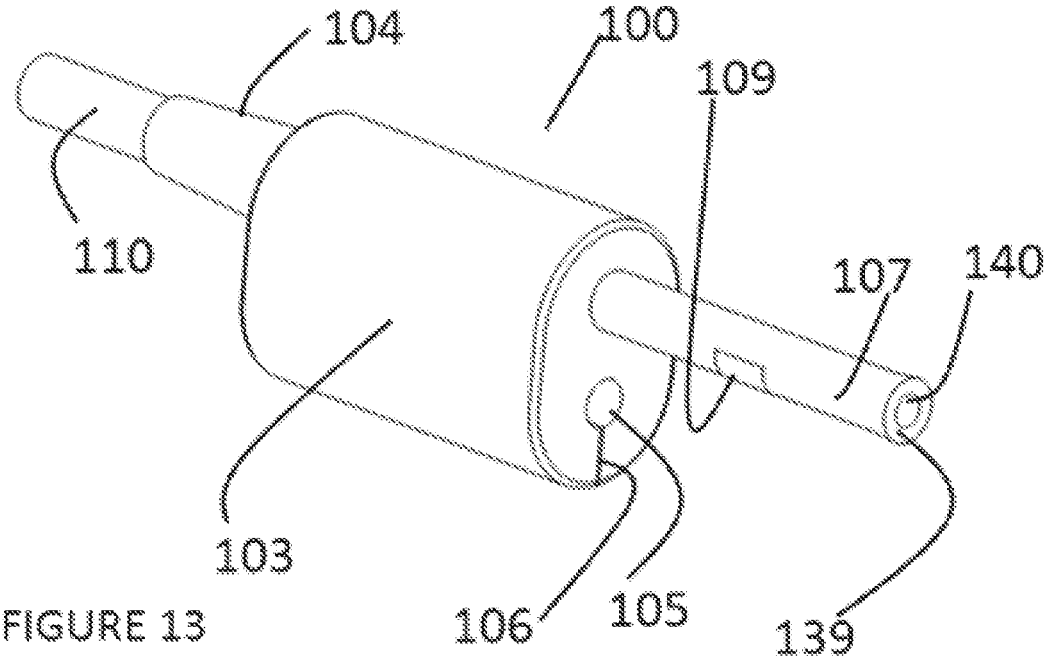
FIG. 13 is a perspective view of connector plug unit having a recess in the plug tip in accordance with one embodiment of the presently disclosed technology.

Plug shaft 107 can be molded onto spine 116 from either rigid or elastomeric dielectric material. In the case where the overmolded material of plug shaft 107 is an elastomer, plug shaft 107 can have a slightly flared wall portion 139, as shown in FIG. 13. Wiping action of flared wall portion 139 on the distal end of plug shaft 107 can add to the flushing action of environmental fluid from channel 122. Recess 140 in the end of plug shaft 107 allows flared wall portion 139 to have a diameter greater than the diameter of channel 122 while still allowing flared end 140 to squeeze radially inward as it passes into channel 122.

Figure 14:
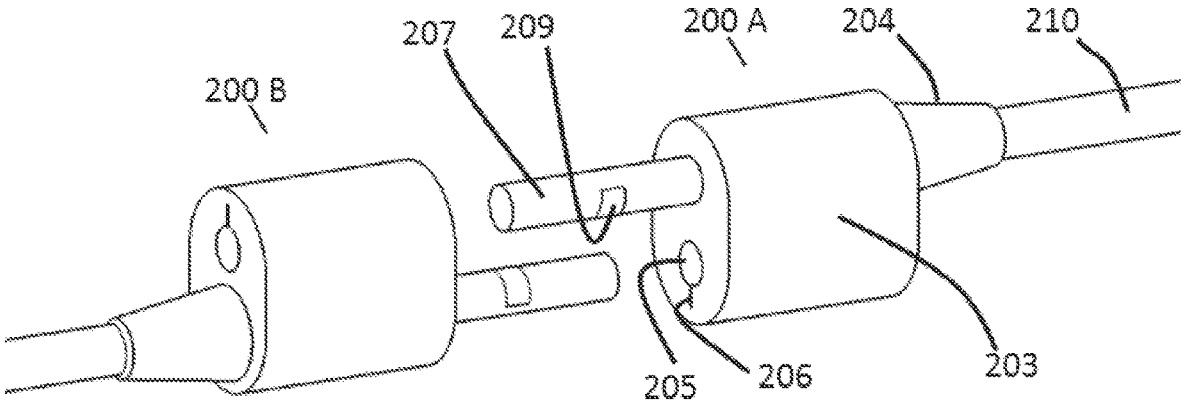
FIG. 14 is a perspective view of two dual circuit connector units poised in juxtaposition for mating.
Figure 15:
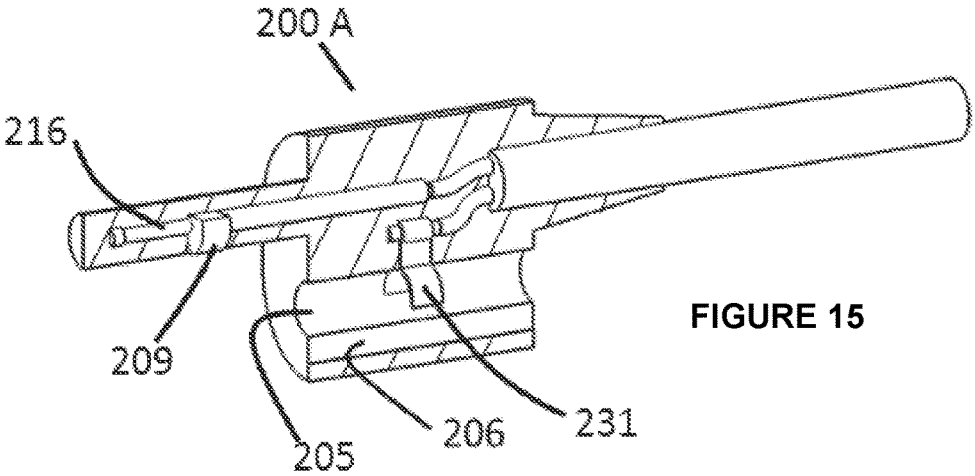
FIG. 15 is a partial axial half-section perspective view of a dual circuit connector unit.

In an alternate embodiment 200A, shown in FIGS. 14, 15, alignment pin 127 of FIG. 11 has been replaced by a second plug shaft having the same attributes as plug shaft 107 of FIG. 9. Additionally, through bore 105 of FIG. 9 has been replaced in the alternate embodiment of FIGS. 14, 15 by channel 205 having along its length contact 231 which is the equivalent of channel 122 of FIG. 10 having along its length contact 131.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the presently disclosed technology. Thus, it is to be understood that the description and drawings presented herein represent presently preferred embodiments of the disclosed technology and are, therefore, representative of the subject matter, which is broadly contemplated by the presently disclosed technology. It is further understood that the scope of the presently disclosed technology fully encompasses other embodiments that may become obvious to those skilled in the art and that the scope of the presently disclosed technology is accordingly limited by nothing other than the appended claims.

I claim:

1. A connector for sealably engaging contacts therein and permitting reliable disengagement thereof, the connector comprising:

a first unit having a body with one or more elongated shafts extending therefrom, each elongated shaft including at least one first contact; and a second unit having an elastomeric body with one or more channels therein, each channel including at least one second contact, each channel being configured to receive at least a portion of an elongated shaft of the first unit therein to permit electrical connection of one or more first contacts on the elongated shaft to the respective one or more second contacts, the second unit being configured to prevent each channel of the second unit from forming a constrictive belt around the one or more elongated shafts therein, wherein the second unit comprises a circumferentially discontinuous portion in each channel, wherein the circumferentially discontinuous portion of each channel is an axial slit extending radially outwardly from each channel.

2. The connector of claim 1, wherein each axial slit of the second unit extends an entire length of the respective channel from one end of the second unit to an opposing end of the second unit.

3. The connector of claim 1, further comprising means for maintaining rotational alignment of the first and second units when the first and second units are engaged.

4. The connector of claim 3, wherein the means for maintaining rotational alignment comprises one or more alignment bores of the first unit spaced-apart from the one or more elongated shafts of the first unit, the means for maintaining rotational alignment further comprises one or more alignment pins of the second unit spaced-apart from the one or more receptacle channels of the second unit, each alignment pin being configured to enter one of the one or more alignment bores of the first unit when the first and second units are engaged.

5. The connector of claim 1, wherein each axial slit of the second unit extends completely through the second unit from one end thereof to an opposing end thereof.

6. The connector of claim 1, wherein each axial slit of the second unit does not extend radially to an outer surface of the second unit such that a portion of the second unit remains uncut.

7. The connector of claim 1, wherein each second contact of the second unit mates to the respective one of the first contacts of the first unit such that the first and second contacts remain sealed from the outside environment.

8. A connector receptacle unit for sealably engaging contacts therein and permitting reliable disengagement thereof, the receptacle unit comprising:

a receptacle body including a channel therein, the channel including a contact configured to receive an elongated shaft of a plug unit of a connector, the contact of the channel being configured to electrically connect to a contact of the plug unit when the elongated shaft enters the channel; and a circumferential discontinuity extending outwardly from an outer surface of the channel, wherein the circumferential discontinuity is an axial slit configured to prevent the receptacle body from forming a constrictive belt around the elongated shaft.

9. The connector receptacle unit of claim 8, wherein the receptacle body is formed of an elastomer.

10. The connector receptacle unit of claim 8, wherein the receptacle unit is maintained in rotational alignment with the plug unit when mated to the plug unit.

* * * * *